US005642823A

United States Patent [19]

Kalina et al.

[11] Patent Number: 5,642,823

[45] Date of Patent: Jul. 1, 1997

[54] RAILCAR SHOCK ABSORBER WITH NEUTRAL POSITION

[75] Inventors: Harry B. Kalina, Arlington; Charles T. Bomgardner, Burleson; Richard N. Hodges, Arlington, all of Tex.

[73] Assignee: FM Industries, Inc., Fort Worth, Tex.

[21] Appl. No.: 666,920

[22] Filed: Jun. 9, 1996

[51] Int. Cl.[6] ..... B61G 9/08

[52] U.S. Cl. ..... 213/43; 188/269; 188/287

[58] Field of Search ..... 213/7, 8, 10, 43, 213/405; 188/269, 287, 312, 316, 322.13, 322.22; 267/64.11

[56] References Cited

U.S. PATENT DOCUMENTS

| | | | |
|---|---|---|---|
| 3,047,162 | 7/1962 | Blake | 188/287 |
| 3,537,598 | 11/1970 | Moody | 213/43 |
| 3,598,249 | 8/1971 | Vickerman | 213/8 |
| 3,791,531 | 2/1974 | Hawthorne | 213/43 |
| 5,024,301 | 6/1991 | Cook | 188/287 |
| 5,415,303 | 5/1995 | Hodges et al. | 213/43 |
| 5,487,480 | 1/1996 | Page et al. | 188/287 |

*Primary Examiner*—S. Joseph Morano
*Attorney, Agent, or Firm*—James E. Bradley

[57] ABSTRACT

A railcar shock absorber has neutral position in which the piston is spaced between buff and draft ends of the cylinder. An external spring is mounted to the shock absorber. A slider rod has one end mounted to the coupling to move relative to the frame of the railcar. The spring has retainers on each end, and the slider rod passes through the retainers. One of the retainers is stationary relative to the frame. The other retainer floats relative to the frame and will abut a neutral stop of the frame when the spring is in the maximum length position. An engagement member on the slider rod will further compress the spring if a draft shock occurs from the neutral position. If a buff shock occurs from the neutral position, the engagement member moves away from the floating retainer.

18 Claims, 5 Drawing Sheets

RAILCAR SHOCK ABSORBER WITH NEUTRAL POSITION

BACKGROUND OF THE INVENTION

1. Field of the Invention

This invention relates in general to railcar cushioning devices, in particular to a railcar cushioning device which is responsive from a neutral position to both buff and draft forces.

2. Description of the Prior Art

Railcars experience a great deal of shock during coupling operations and other train action which can damage cargo on the railcars and the railcars themselves. To absorb the high forces experienced by railcars during these operations, cushioning devices have been employed between the frame of the railcar and its coupler.

The shock experienced by railcars results from both buff and draft forces applied to the coupler of the railcar. The term "buff" is used to describe the movement experienced by a coupler when it is moved towards its associated railcar. These buff forces are usually experienced during coupling operations between the railcars. "Draft" describes the outward movement of the coupler away from its associated railcar in response to pulling forces acting on the coupler.

These cushioning devices are usually hydraulic piston and cylinder arrangements which absorb both buff and draft forces. The cylinders are filled with a hydraulic fluid which is forced through ports in the cylinder wall in response to the impact force applied to the piston. Characteristic of these cushioning devices, however, is the low level of impedance they provide in response to very low buff and draft forces. This response to very low buff and draft forces creates the undesirable effect of "slack" between the railcars.

There is a need therefore for a cushioning device for a railcar that operates at a very high impedance when subjected to low level forces to thereby reduce the effect of slack between the railcars while still providing an effective cushion for absorbing high levels of shock between the railcars.

In addition, prior art shock absorbers when not undergoing shock will restore the piston and shock absorber to an extended position. The restoration occurs due to gas pressure in the cylinder pushing the piston to the extended position. If a draft shock occurs while the piston is in the full extended position, the shock absorber will not be able to accommodate the draft shock because the railcar pocket stops mechanically prohibit further extension movement.

SUMMARY OF THE INVENTION

The cushioning device of this invention has a neutral position for the piston. In the neutral position, the piston is located at an intermediate position, spaced between the buff and draft ends of the cylinder. If a buff shock occurs while in the neutral position, the piston and cylinder move relative to each other, with the piston moving towards the buff end to absorb the shock. Liquid in the cylinder passes through ports into the reservoir during this movement. Preferably, pressure relief valves will be located in at least some of the ports for requiring a minimum pressure before movement of the piston can occur. If a draft movement occurs, the piston will move toward the draft end of the cylinder, also absorbing shock.

To provide the neutral position, a spring is employed external of the cylinder. The spring allows free restoration of the piston until the piston reaches the neutral position. Upon reaching the neutral position, any continued movement of the piston towards the draft end of the cylinder must further compress the spring. The spring force is selected to be greater than the force being exerted by gas pressure on the piston during restoration, therefore, stopping the piston at the neutral position. If draft shock occurs while in the neutral position, the piston will further compress the spring.

In the preferred embodiment, the spring is mounted exterior the cylinder parallel to the longitudinal axis of the cylinder. The spring has a buff end that is mounted stationery to the frame. The rearward end of the spring will contact a neutral stop, which is also mounted stationery to the spring. A slider rod is mounted to the cylinder for movement with the cylinder. The slider rod slidably engages a retainer of the rearward end of the spring. A retainer engagement nut on the slider rod will allow the rod to pass through the neutral stop when undergoing buff shock from the neutral position. The engagement nut on the slider rod will engage the spring retainer and further compress the spring if the shock absorber undergoes draft shock while in the neutral position. The neutral position occurs when the retainer is in contact with the neutral stop and when the engagement nut on the slider rod is in contact with the retainer.

DETAILED DESCRIPTION OF THE PREFERRED EMBODIMENT

Figure 1:
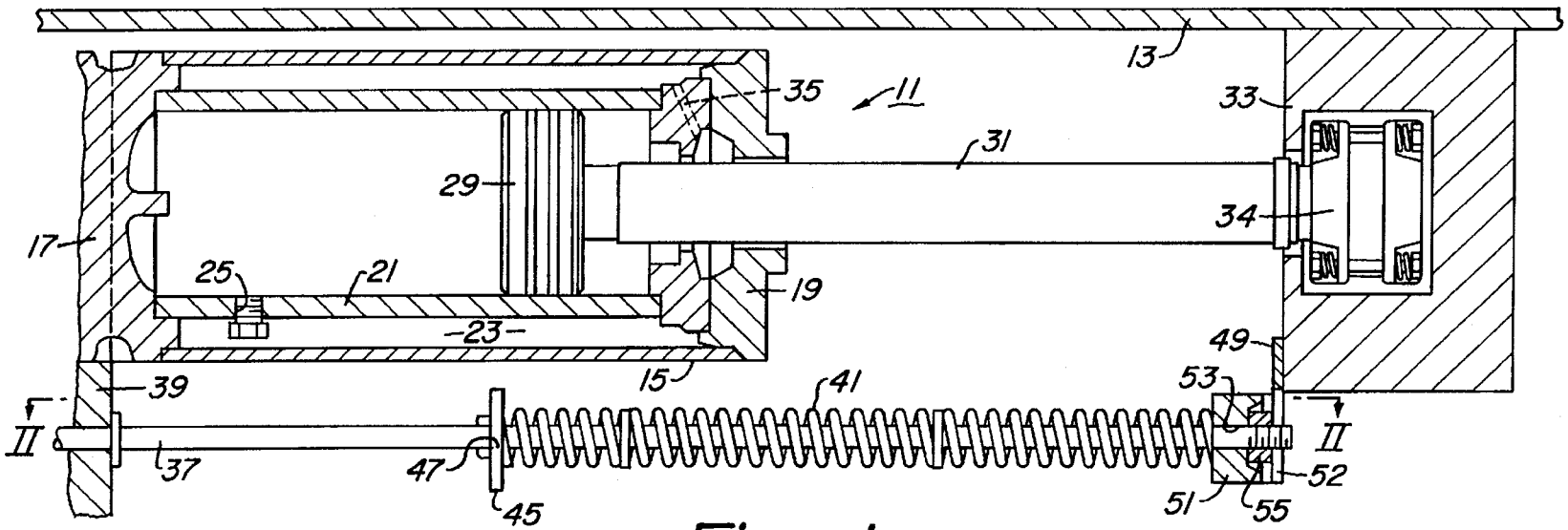
FIG. 1 is a vertical sectional view, partially schematic, illustrating a railcar shock absorber constructed in accordance with this invention and shown in the neutral position.

Referring to FIG. 1, shock absorber 11 is a type to be installed in a railcar having a center sill or frame 13. In the embodiment of FIGS. 1–8, shock absorber 11 has a cylinder housing 15 that moves relative to frame 13. Cylinder housing 15 has a coupling end 17 that has to be secured to a conventional railcar coupling. A cylinder head plate 19 locates at the other end of cylinder housing 15. A pocket stop (not shown) is welded to frame 13 in a position to be contacted by coupling end 17 and stop movement of cylinder housing 15 when it has moved to a maximum draft position.

Figure 7:
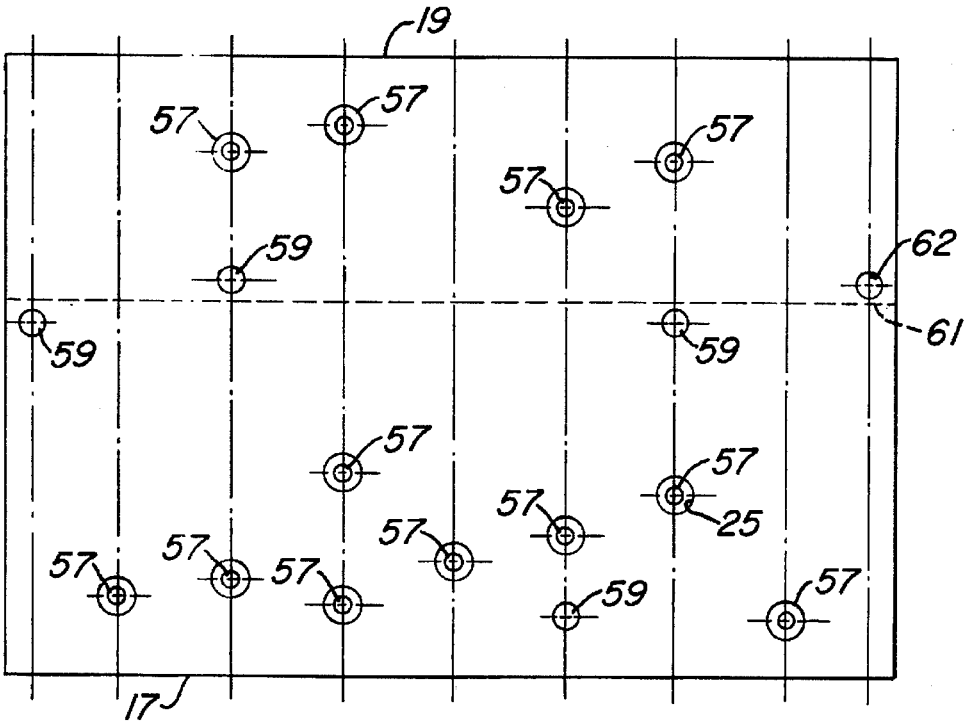
FIG. 7 is a schematic illustration of the ports in the cylinder of the shock absorber of FIG. 1, showing the cylinder laid flat.

An inner cylinder 21 is carried within cylinder housing 15. An annular clearance between inner cylinder 21 and housing 15 serves as a reservoir 23. A plurality of ports 25 are located in the side wall of cylinder 21 for communicating oil and gas between reservoir 23 and the interior of cylinder 21. Only a single port is shown in FIG. 1, with FIG. 7 illustrating the ports and the various valves in detail.

A piston 29 is located within cylinder 21 for relative reciprocating movement. Piston 29 has a piston shaft 31 that extends outward through head plate 19. In the embodiment of FIGS. 1–8, piston shaft 31 has a flange 34 on its end which is stationarily secured to a brace or backstop 33, which welded to a part of a railcar frame 13, such as the center sill, and is shown schematically in FIGS. 1, 3 and 4. For convenience only, the piston 29 at times may be considered to move while the cylinder 21 is stationary or vice versa, although the movement is actually a relative movement between the cylinder 21 and piston 29. Piston 29 is located in a neutral position in FIG. 1, in a buff position in FIG. 3, and in a draft position in FIG. 4. When in a full buff position, the exterior side of cylinder head plate 19 will contact backstop 33. A return flow passage 35 communicates fluid from reservoir 23 back to the cylinder 21 on the shaft side of piston 29 when piston 29 moves toward coupling end 17 relative to cylinder 21.

A slider rod 37 has one end rigidly mounted to a bracket 39, which in turn is mounted to coupling end 17 of cylinder housing 15. Slider rod 37 will thus move in unison with cylinder housing 15 relative to frame 13 and piston shaft 31. Slider rod 37 is located on the exterior of cylinder housing 15 and is parallel to the longitudinal axis of cylinder 21. Slider rod 37 has a length that is greater than the length of cylinder housing 15 in the embodiment shown, but somewhat less than the total length of shock absorber 11, including shaft 31.

Figure 2:
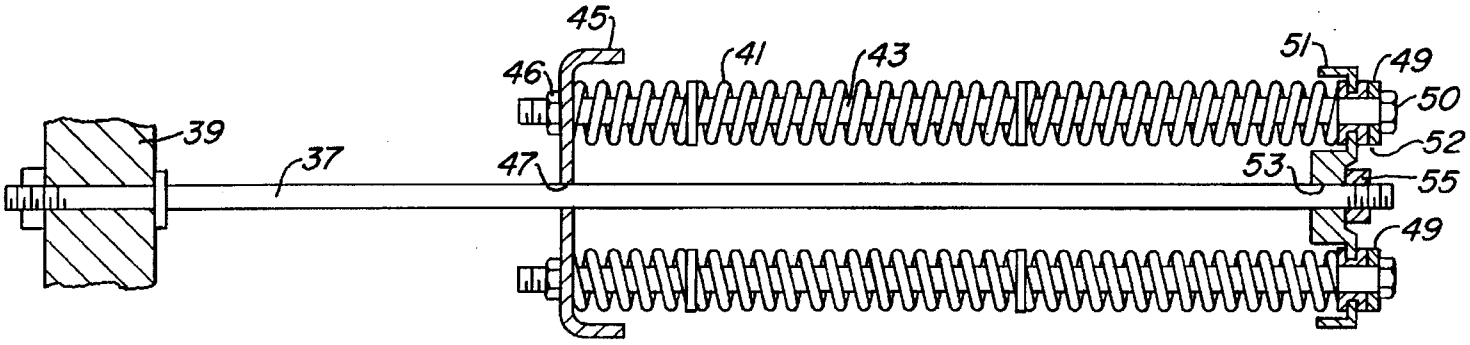
FIG. 2 is a sectional view of the shock absorber of FIG. 1, taken along the line II—II of FIG. 1.

As shown in FIG. 2, a pair of coil springs 41 extend along opposite sides of slider rod 37, parallel with slider rod 37. A spring rod 43 extends concentrically through each coil spring 41. Spring rod 43 is supported on one end by a retainer 45 which will be referred herein as a fixed spring retainer 45, because once shock absorber 11 is installed and adjusted, the position of fixed spring retainer 45 relative to frame 13 does not change. A nut 46 secures one end of each spring rod 43 rigidly to fixed spring retainer 45, and compresses the coil springs 41 to a selected amount. Slider rod 37 extends slidingly through a central hole 47 in fixed spring retainer 45. The opposite ends of spring rods 43 are supported by a neutral stop 49. Neutral stop 49 is a flat plate that is rigidly secured by welding or the like to frame 13 or backstop 33. Neutral stop 49 has a central slot 52, dividing neutral stop 49 into two depending plates. Bolt heads 50 on the ends of spring rods 43 engage neutral stop 49 to stationarily secure spring rods 43 to neutral stop 49 and thus to frame 13. A central slot 52 extends through the lower portion of neutral stop 49.

Figure 6:
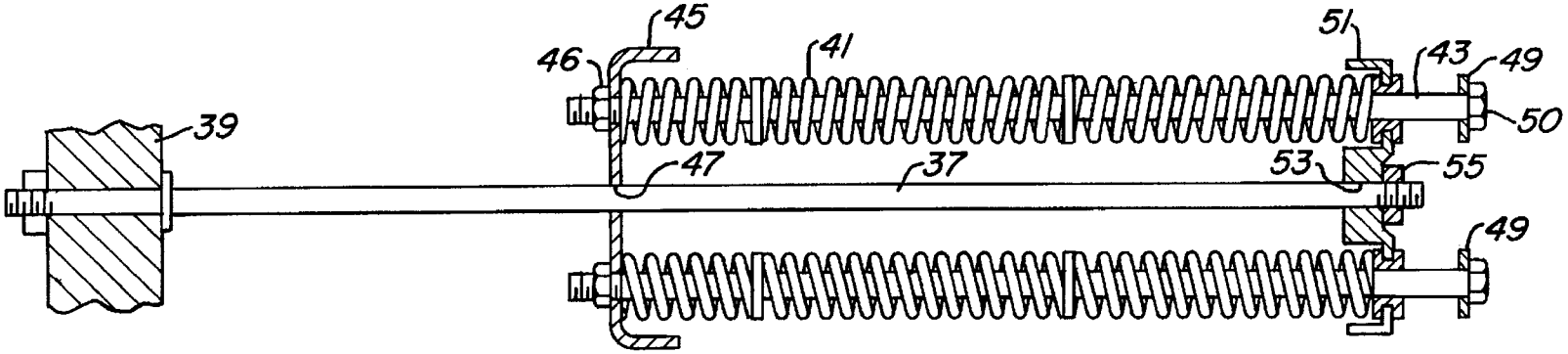
FIG. 6 is a sectional view of the shock absorber as shown in FIG. 4, taken along the line VI—VI of FIG. 4.

A floating spring retainer 51 is located at the ends of springs 41 opposite fixed spring retainer 45. Floating spring retainer 51 retains the ends of springs 41 and will slide relative to spring rods 43 as shown in FIG. 6. In the neutral position and during buff movement, floating spring retainer 51 abuts neutral stop 49, preventing any further expansion of springs 41. The maximum expansion of springs 41 is limited by the lengths of spring rods 43. Springs 41 can be further contracted from the maximum position during a draft movement, as illustrated in FIG. 6. A central hole 53 extends through floating spring retainer 51. Slider rod 37 extends slidingly through hole 53.

Figure 3:
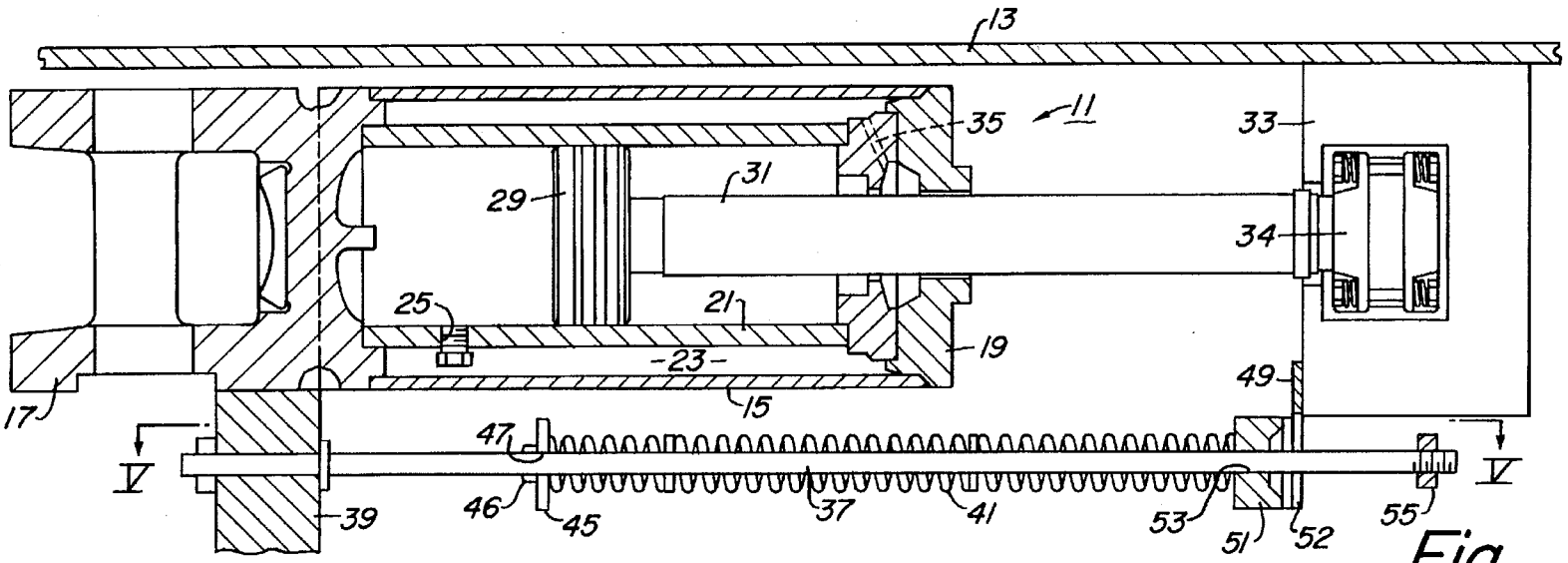
FIG. 3 is a vertical sectional view of the shock absorber of FIG. 1, shown moving in a buff direction from the neutral position of FIG. 1.
Figure 4:
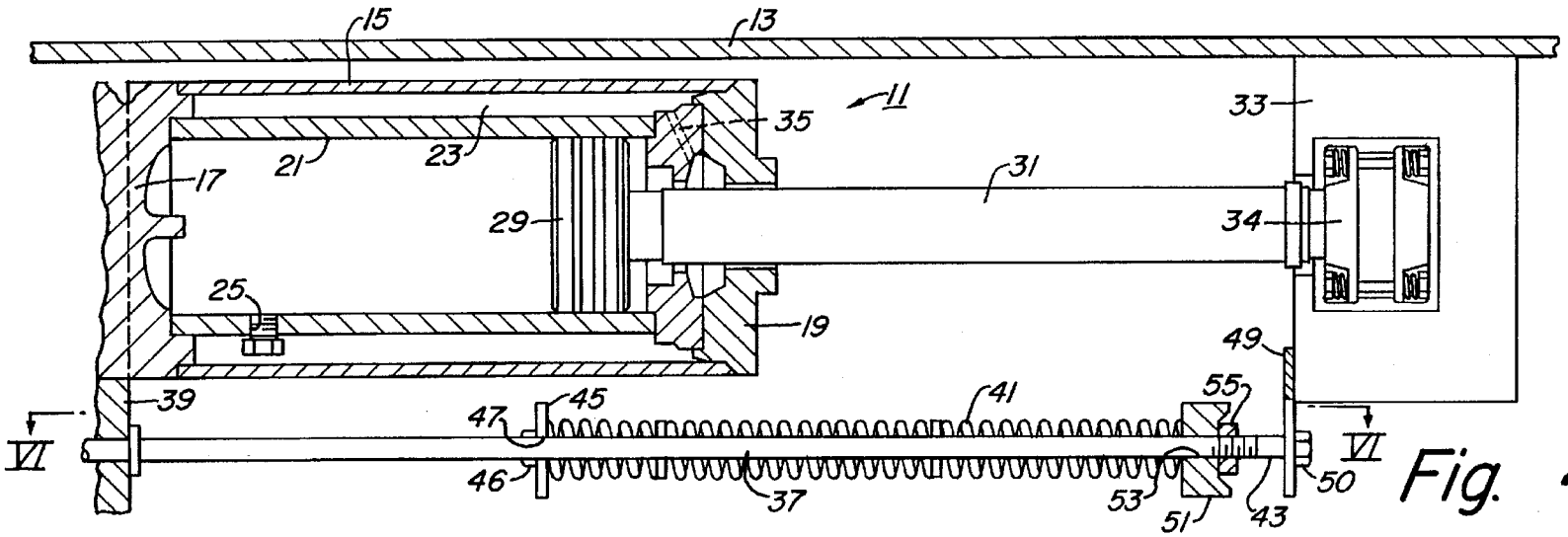
FIG. 4 is a vertical sectional view of the shock absorber of FIG. 1, shown positioned in a draft direction from the neutral position of FIG. 1.

An engagement member or nut 55 is located on one end of slider rod 37. Engagement member 55 will abut the floating retainer 51 when in the neutral position. When moving from the neutral to a draft position, as shown in FIG. 6, engagement nut 55 pushes floating spring retainer 51 toward fixed spring retainer 45, further compressing springs 41. Engagement nut 55 passes through the neutral slot 52, further compressing springs 41, as shown in FIG. 4. Slider rod 37 is free to move away from neutral stop 49 and floating spring retainer 51 when undergoing buff movement, as shown in FIG. 3. Slider rod 37 does not further compress springs 41 when undergoing buff movement as shown in FIG. 3.

In one embodiment, piston 29 is capable of stroking fifteen inches from the full buff position to the full draft position. The neutral position is selected in that embodiment to allow piston 29 to move ten inches from the neutral position to a full buff position with cylinder head plate 19 in contact with the backstop 33. Piston 29 will be closely spaced to but not touching the interior side of coupling end 17 when in the full buff position. Piston 29 is capable of moving five inches from the neutral position to the full draft position shown in FIG. 4, with coupling end 17 contacting the pocket stop (not shown) attached to frame 13. Piston 29 will be closely spaced to but not touching the interior side of cylinder head plate 19 when in the full draft position.

FIG. 7 schematically illustrates the positions of the ports 25 in the sidewall of cylinder 21. In FIG. 7, cylinder 21 is shown laid flat, with the left and right sides of the drawing being the top of cylinder 21. Preferably, the ports 25 will have various valves so as to require a significant force to occur while in the neutral position before piston 29 and cylinder 21 (FIG. 1) will move relative to each other. These valves include a number of pressure relief valves 57 which are preset to require a pressure differential between cylinder 21 and reservoir 23 of significant magnitude, such as approximately 1500 psi. The valves 57 will not allow any flow from reservoir 23 back into cylinder 21, but will allow outflow if the pressure differential reaches the selected amount.

There are also several equalizing valves 59. Equalizing valves 59 are check valves of a movable ball type that will allow at a low pressure differential a low flow rate of fluid from cylinder 21 into reservoir 23. If a high pressure differential occurs, such as a buff shock, however, the balls move up against the seats and prevent egress from cylinder 21 to reservoir 23. Equalizing valves 59 allow the fluid pressure between cylinder 21 and reservoir 23 to slowly equalize while not undergoing shock.

There is also a restoration valve 62, which is a normally open valve which closes under pressure. Restoration valve 62 allows fluid to flow from cylinder 21 on the shaft side of piston 29 back into reservoir 23 during restoration movement. Restoration movement occurs when there is no shock happening, and it is due to the internal gas pressure in cylinder 21 pushing piston 29 from a buff position back to the neutral position shown in FIG. 1. Restoration valve 62 is of a type that will close if a draft shock occurs while the restoration movement is taking place. This prevents fluid flow through restoration valve 62 from the cylinder 21 on the shaft side of piston 21 if a draft shock occurs during restoration. The closure of restoration valve 62 forces any of the fluid flowing out of the cylinder 21 on the shaft side of piston 29 into reservoir 23 due to a draft shock to flow through the pressure relief valves 57 located on the shaft side of piston 29. The numeral 61 in FIG. 7 shows an approximate neutral position of piston 29.

Figure 8:
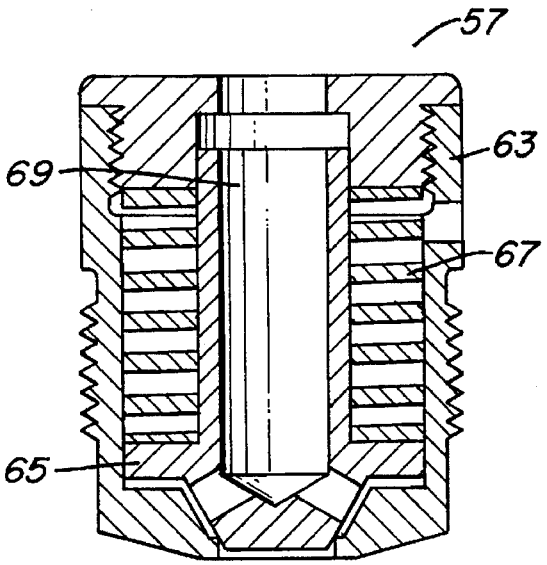
FIG. 8 is a vertical sectional view of one of the pressure relief valves employed with the shock absorber of FIG. 1.

FIG. 8 illustrates a preferred pressure relief valve 57. Pressure relief valve 57 has a body 63 which secures by threads to one of the ports 25 in cylinder 21 (FIG. 7). A plunger 65 will move axially within body 63. A coil spring 67 urges plunger 65 to a seated position as shown in FIG. 8. A passage 69 extends through plunger 65 and opens to allow fluid flow if a sufficient pressure differential exists.

In the operation of the embodiment of FIGS. 1–8, shock absorber 11 will be mounted in frame 13 as shown. It will be charged with a fluid, which comprises an oil and a gas such as nitrogen under a selected pressure. In FIG. 1, the shock absorber 11 is under equilibrium, in a neutral position. Internal gas pressure in cylinder 21 urges cylinder 21 to the left relative to piston 29. Engagement nut 55 on slider rod 37 is in contact with floating spring retainer 51, however, in the neutral position. Because slider rod 37 moves in unison with cylinder 21, for cylinder 21 to move any further to the left from that shown in FIG. 1, engagement nut 55 would have to compress springs 41 further. The force of the springs 41 is selected to be greater than the force exerted by the internal gas pressure in cylinder 21 while undergoing restoration, so as to prevent any movement from the neutral position unless a significant buff or draft shock occurs. Preferably, the force of springs 41 is set so as to require about 3,000 lbs. of force to cause it to compress from the neutral position shown in FIG. 1. In that neutral position, springs 41 will be at their maximum extent, with floating spring retainer 51 abutting neutral stop 49.

Figure 5:
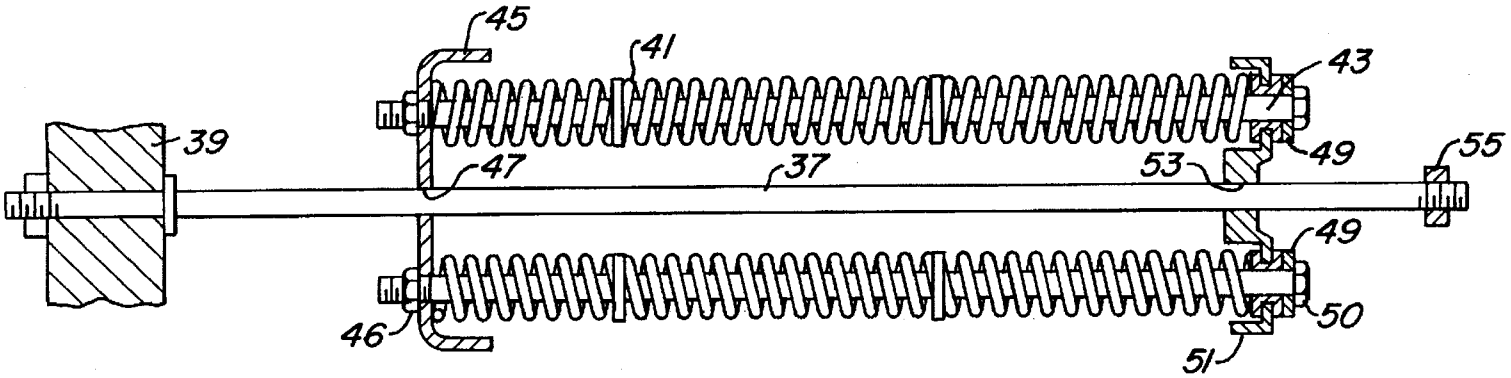
FIG. 5 is a sectional view of the shock absorber as shown in FIG. 3, taken along the line V—V of FIG. 3.

If a buff shock occurs and if the shock is sufficient to open the pressure relief valves 57, then cylinder 21 will move to the right relative to piston 29, as shown in FIGS. 3 and 5. Slider rod 37 moves with cylinder 21, sliding freely through spring retainers 45, 51. Engagement nut 55 moves to the right of neutral stop 49. Springs 41 are not further compressed. During the buff action, the fluid within cylinder 21 on the coupling end 17 of cylinder 21 is pushed out through the various pressure relief valves 57 into reservoir 23. At the same time, return flow is allowed from reservoir 23 back through return passage 35 to the shaft side of piston 29.

After the buff shock has occurred, shock absorber 11 will begin to restore to the neutral position. Internal gas pressure within cylinder 21 on the coupling side of piston 29 will push cylinder 21 in the left direction relative to piston 29. This is a fairly slow process, and during this process, equalizing valves 59 (FIG. 7) and restoration valve 62 will allow communication between cylinder 21 and reservoir 23. Pressure relief valves 57 will be closed during the restoration movement. If during the restoration movement a draft shock occurs, equalizing valves 59 will close, requiring any egress from cylinder 21 to be through the pressure relief valves 57. If while undergoing restoration movement a draft shock occurs, restoration valves 62 will close, requiring any egress from the cylinder 21 on the shaft side of piston 29 to flow through the pressure relief valves 57. Restoration will be complete when engagement nut 55 contacts floating spring retainer 51. At this point, the internal gas pressure in cylinder 21 will not be sufficient to further compress springs 41.

If a draft shock occurs while in the neutral position, shock absorber 11 will appear as shown in FIGS. 4 and 6. The draft shock has to be sufficient to open the pressure relief valves 57 and also sufficient to compress springs 41. Preferably, the force of the springs 41 is much lower than that required to open the pressure relief valves 57 for a draft movement. Preferably, springs 41 will compress if an impact of 3,000 pounds is applied, while an impact of 50,000 to 100,000 pounds force is required to open the pressure relief valves 57 on the shaft side of piston 29 while piston 29 is in the neutral position. If the draft shock is sufficiently severe, cylinder 21 will move to the left relative to piston 29, and slider rod 37 moves with cylinder 21 to further compress springs 41. Shock is absorbed by the fluid flowing through the pressure relief valves 57 on the shaft side of piston 29, not by further compression of the springs 41. After the draft shock is over, springs 41 will push cylinder 21 to the right relative to piston 29, until floating spring retainer 51 abuts neutral stop 49. Springs 41 serve as the restoration mean to restore the piston 29 from the full draft position to the neutral position.

Figure 9:
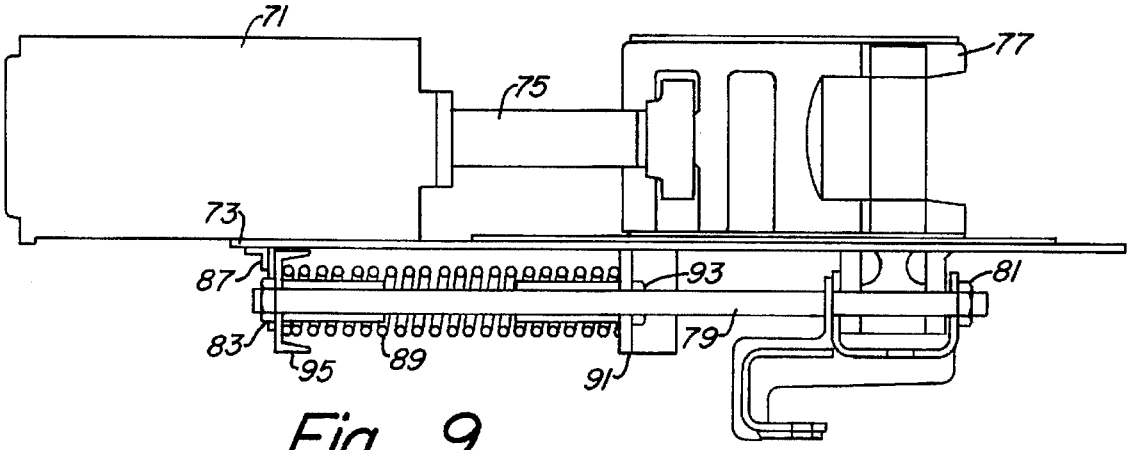
FIG. 9 is partially sectioned side view of a second embodiment of a shock absorber constructed in accordance with this invention, and shown in a neutral position.
Figure 10:
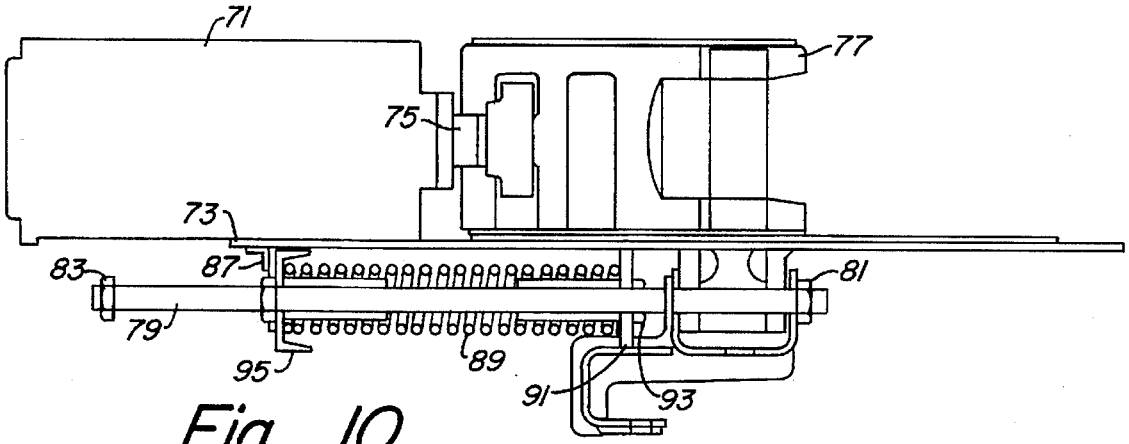
FIG. 10 is a external view of the shock absorber of FIG. 9, shown undergoing a buff movement.
Figure 11:
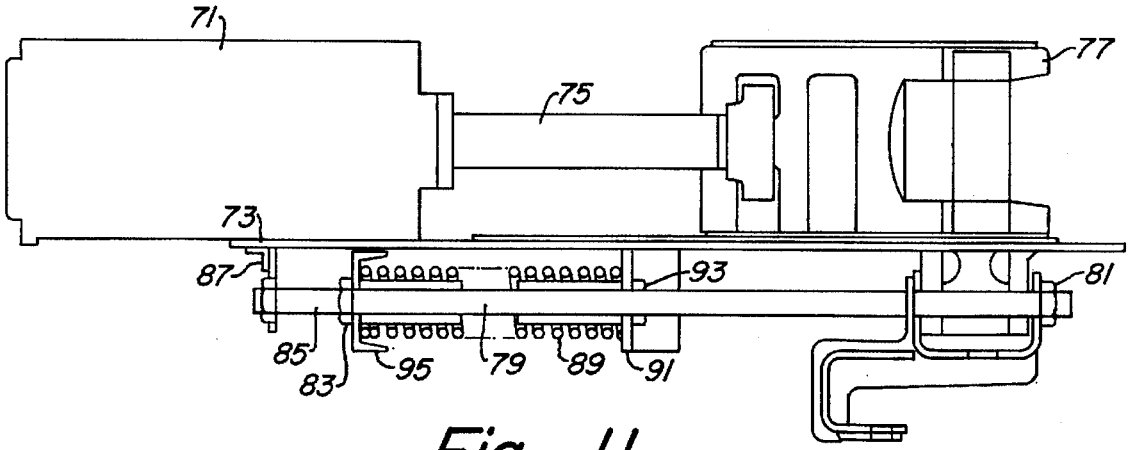
FIG. 11 is a sectional view of the shock absorber of FIG. 9, shown undergoing a draft movement from the neutral position.

In FIGS. 1–8, the shock absorber 11 is of a type that mounts the piston 29 stationarily to the frame 13, with the cylinder 21 being movable relative to the railcar frame 13. In FIGS. 9–11, the opposite is utilized. The principles, however, are the same. Referring to FIG. 9, cylinder housing 71 is mounted stationarily to railcar frame 73. Piston shaft 75 will move relative to frame 73, and is connected on its end to a railcar coupling 77 of conventional design.

Slider rod 79 moves with piston shaft 75 in this instance, and in both embodiments, it moves relative to railcar frame 73. Slider rod 79 has a coupling nut 81 on one end that rigidly couples slider rod 79 to coupling 77. An engagement nut 83 is located on the other end of slider rod 79. A pair of spring rods 85 (only one shown) are shown more clearly shown in FIG. 11. Spring rods 85 have one end rigidly secured to a neutral stop 87. Neutral stop 87 is rigidly secured to frame 73, just as in the first embodiment. Coil springs 89 (only one shown) are mounted over the spring rods 85. A fixed spring retainer 91 is fixed relative to frame 73 by means of nuts 93 on the ends of spring rods 85. A floating spring retainer 95 will slide on the spring rods 85. Floating spring retainer 95 will abut the neutral stop 87 when springs 89 are in the full expanded position. Cylinder housing 71 is configured as in first embodiment, having an inner cylinder or reservoir and various valves as previously explained.

In the operation of the embodiments of FIGS. 9–11, FIG. 9 shows the neutral position. In that position, a piston within cylinder housing 71 will be spaced a selected distance from each end of the cylinder housing 71. FIG. 10 illustrates a buff movement occurring from the neutral position. Coupling 77 moves to the left relative to cylinder housing 71 and frame 73. Slider rod 79 moves to the left along with coupling 77. Piston shaft 75 will move inward within cylinder housing 71. Springs 89 will not be compressed any further than when in the neutral position. After the buff shock is over, the shock absorber will restore to the neutral position due to internal gas pressure as previously explained.

FIG. 11 illustrates a draft shock occurring from the neutral position. Coupling 77 moves to the right relative to cylinder housing 71 and frame 73. Engagement nut 83 will push floating spring retainer 95 to the right relative to fixed spring retainer 91, further compressing springs 89. Floating spring retainer 95 will slide on the spring rods 85 as this occurs. Shock will be absorbed primarily through the fluid passing through the valves as previously explained. Once the draft shock is over, the shock absorber will restore, with springs 89 expanding until floating spring retainer 95 contacts neutral stop 87.

The invention has significant advantages. The neutral stop allows the shock absorber to handle both draft and buff shocks that may occur from the neutral position. The external spring allows a neutral position to be employed with a piston and cylinder that utilizes internal gas pressure. The pressure relief valves require a significant minimum force to be applied in both the buff and draft directions before absorbing shock.

While the invention has been shown in only two of its forms, it should be apparent to those skilled in the art that it is not so limited but is susceptible to various changes without departing from the scope of the invention.

We claim:

1. A railcar shock absorber, comprising in combination:

a cylinder which has a buff end and a draft end and containing a liquid and gas fluid under gas pressure for absorbing shock due to buff and draft movement;

a piston carried in the cylinder;

a piston shaft extending from the piston sealingly through the draft end of the cylinder, the gas pressure urging the piston toward the draft end of the cylinder while restoring from a buff shock;

one of the piston shaft and the cylinder adapted to be secured stationarily to a frame of the railcar and the other of the piston shaft and the cylinder adapted to be secured to a coupling for coupling to adjacent railcars; and spring means for stopping further restoring movement of the piston toward the draft end of the cylinder at a selected neutral position spaced from the draft end of the cylinder, and for allowing the piston to move from the neutral position toward the draft end of the cylinder if a draft shock occurs of sufficient magnitude while the piston is in the neutral position.

2. The shock absorber according to claim 1, wherein the spring means comprises:

at least one coil spring having a stationary end and a floating end; and means for mounting the coil spring to the shock absorber exterior of the cylinder with the stationary end of the spring stationary relative to the frame and the floating end being movable relative to the frame, such that additional movement of the piston from the neutral position toward the draft end of the cylinder must push the floating end toward the stationary end to further compress the spring.

3. The shock absorber according to claim 1, wherein the spring means comprises:

at least one coil spring having a stationary end and a floating end;

means for mounting the coil spring to the exterior of the cylinder with the stationary end stationary relative to the frame, with the floating end being movable relative to the frame, and with the spring under compression while the piston is in the neutral position; and engagement means movable relative to the frame during relative movement between the piston and the cylinder, for allowing buff movement of the piston from the neutral position without further compression of the spring, and for engaging the floating end of the spring, requiring further compression of the spring for draft movement of the piston from the neutral position.

4. The shock absorber according to claim 1, wherein the spring means comprises:

at least one coil spring having a stationary end and a floating end;

a neutral stop;

means for mounting the neutral stop stationarily to the frame;

mounting means for mounting the spring exterior of the cylinder with the floating end compressed against the neutral stop while the piston is in the neutral position;

a slider rod mounted exterior of the cylinder for corresponding movement relative to the frame during buff and draft movement; and engagement means mounted to the slider rod for movement therewith and for contacting the floating end of the spring while the piston is in the neutral position, for pushing the floating end toward the fixed end in a first direction to further compress the spring if a draft shock of sufficient magnitude occurs while the piston is in the neutral position, and for moving away from the floating end of the spring and from the neutral stop in a second direction if a buff shock of sufficient magnitude occurs while the piston is in the neutral position.

5. The railcar shock absorber according to claim 1, further comprising:

a reservoir extending around the cylinder;

a plurality of ports in the cylinder for forcing the fluid from the cylinder into the reservoir during buff and draft shock, some of the ports being located on the buff side of the piston while the piston is in the neutral position, at least one of the ports being located on the draft side of the piston while the piston is in a neutral position;

a return passage between the cylinder and the reservoir for returning fluid from the reservoir to the cylinder as the piston is restored to the neutral position; and pressure relief valve means in at least some of the ports on both the buff and draft sides of the piston while the piston is in the neutral position, for requiring an initial pressure differential between the cylinder and the reservoir before allowing fluid flow through said at least some of the ports from the cylinder to the reservoir.

6. In a railcar shock absorber having a cylinder which has a buff end and a draft end, a piston carried in the cylinder, a piston shaft extending from the piston sealingly through the draft end of the cylinder, one of the piston shaft and the cylinder adapted to be secured stationarily to a frame of the railcar and the other of the piston shaft and the cylinder adapted to be secured to a coupling, and the cylinder containing a liquid and gas fluid under gas pressure for absorbing shock due to buff and draft movement, the improvement comprising:

at least one coil spring mounted exterior of the cylinder and having a stationary end and a floating end, the stationary end adapted to be mounted stationarily with the frame, the floating end adapted to be movable relative to the frame;

a floating retainer mounted on the floating end of the coil spring for movement with the floating end;

a slider rod mounted to selectively the cylinder and the piston shaft for movement therewith; and an engagement member on the slider rod for movement therewith, for contacting the floating retainer when the piston is in a neutral position spaced from the buff and draft ends of the cylinder, wherein the spring has a force which prevents further restoring movement of the piston from the neutral position toward the draft end of the cylinder due to gas pressure, wherein a draft shock of sufficient magnitude occurring while the piston is in the neutral position causes the engagement member to move the floating retainer toward the stationary end of the spring to compress the spring, and a buff shock of sufficient magnitude occurring while the piston is in the neutral position causes the engagement member to move in a direction away from the floating retainer.

7. The shock absorber according to claim 6, wherein the piston is located closer to the draft end than the buff end of the cylinder while in the neutral position.

8. The shock absorber according to claim 6, further comprising:

a neutral stop adapted to be mounted stationarily to the frame for contact by the floating retainer to compress the coil spring to a selected amount while the floating retainer is in contact with the neutral stop; and wherein the engagement member moves the floating retainer out of contact with the neutral stop when a draft shock of sufficient magnitude occurs while the piston is in the neutral position.

9. The shock absorber according to claim 6, further comprising:

a reservoir extending around the cylinder;

a plurality of buff ports communicating the cylinder with the reservoir, the buff ports being located on the buff side of the piston while the piston is in the neutral position;

at least one draft port communicating the cylinder with the reservoir, the draft port being located on the draft side of the piston while the piston is in a neutral position;

a return passage between the cylinder and the reservoir for returning fluid from the reservoir to the cylinder as the piston is restored to the neutral position; and buff pressure relief valve means in at least some of the buff ports for requiring an initial pressure differential between the reservoir and the cylinder before allowing fluid flow through said at least some of the buff ports from the cylinder to the reservoir while undergoing a buff shock when the piston is in a neutral position; and draft pressure relief valve means in the draft port for requiring an initial pressure differential between the reservoir and the cylinder before allowing fluid flow through the draft port from the cylinder to the reservoir while undergoing a draft shock when the piston is in a neutral position.

10. In a railcar having a frame, a shock absorber having a cylinder which has a buff end and a draft end and a longitudinal axis, a piston carried in the cylinder, a piston shaft extending from the piston sealingly through the draft end of the cylinder, one of the cylinder and piston shaft being stationarily secured to the frame and the other of the cylinder and piston shaft being stationarily secured to a coupling, and the cylinder containing a liquid and gas fluid under gas pressure for absorbing shock due to buff and draft movement, the improvement comprising:

a neutral stop stationarily carried by the frame;

at least one spring rod extending parallel to the longitudinal axis exterior of the cylinder, the spring rod having a neutral stop end stationarily mounted to the neutral stop and a stationary retainer end;

a stationary retainer which is mounted stationarily to the stationary retainer end of the spring rod;

a floating retainer which is slidably carried by the spring rod;

at least one coil spring encircling the spring rod and compressed between the stationary retainer and the floating retainer, which contacts the neutral stop to limit further expansion of the coil spring;

a slider rod mounted to selectively the cylinder and the piston shaft for movement therewith and slidably engaging the floating retainer; and an engagement member mounted to the slider rod for movement therewith and for engaging the floating retainer, the retainer engagement member being movable relative to the neutral stop and movable in one direction relative to the floating retainer; wherein the piston is in a neutral position spaced from the buff and draft ends of the cylinder when the floating retainer is in contact with the neutral stop and when the engagement member is in contact with the floating retainer; wherein if a draft shock of sufficient magnitude occurs while the piston is in the neutral position, the engagement member will move the floating retainer from the neutral stop toward the stationary retainer, further compressing the spring; and wherein if a buff shock of sufficient magnitude occurs while the piston is in the neutral position, the engagement member will move away from the neutral stop and from the floating retainer.

11. The railcar according to claim 10, wherein:

the cylinder is movable relative to the frame; and the slider rod moves in unison with the cylinder.

12. The railcar according to claim 10, wherein:

the piston shaft is movable relative to the frame; and the slider rod moves in unison with the piston shaft.

13. The railcar according to claim 10, wherein:

there are two of the spring rods, each being parallel to and spaced on opposite sides of the slider rod; and there are two of the coil springs, each encircling one of the spring rods.

14. The railcar according to claim 10, wherein the piston is located closer to the draft end than the buff end of the cylinder while in the neutral position.

15. The railcar according to claim 10, further comprising:

a reservoir extending around the cylinder;

a plurality of buff ports communicating the cylinder with the reservoir, the buff ports being located on the buff side of the piston while the piston is in the neutral position;

at least one draft port communicating the cylinder with the reservoir, the draft port being located on the draft side of the piston while the piston is in a neutral position;

a return passage between the cylinder and the reservoir for returning fluid from the reservoir to the cylinder as the piston is restored to the neutral position; and buff pressure relief valve means in at least some of the buff ports for requiring an initial pressure differential between the reservoir and the cylinder before allowing fluid flow through said at least some of the buff ports from the cylinder to the reservoir while undergoing a buff shock when the piston is in a neutral position; and draft pressure relief valve means in the draft port for requiring an initial pressure differential between the reservoir and the cylinder before allowing fluid flow through the draft port from the cylinder to the reservoir while undergoing a draft shock when the piston is in a neutral position.

16. A method for absorbing buff and draft shock in a railcar, comprising:

(a) mounting to the railcar a cylinder which has a buff end and a draft end, a piston carried in the cylinder, and a piston shaft extending from the piston sealingly through the draft end of the cylinder;

(b) placing in the cylinder a liquid and gas fluid under gas pressure;

(c) securing one of the piston shaft and the cylinder stationarily to a frame of the railcar and the other of the piston shaft and the cylinder to a coupling for coupling to adjacent railcars;

(d) while free of buff and draft shock, restoring the piston toward the draft end of the cylinder due to the gas pressure;

(e) stopping further restoring movement of the piston toward the draft end of the cylinder at a selected neutral position spaced from the draft end of the cylinder;

(f) allowing the piston to move from the neutral position toward the draft end of the cylinder if a draft shock occurs of sufficient magnitude while the piston is in the neutral position; and (g) allowing the piston to move from the neutral position toward the buff end of the cylinder if a buff shock occurs of sufficient magnitude while the piston is in the neutral position.

17. The method according to claim 16, wherein step (e) comprises:

mounting a spring to the exterior of the cylinder such that it has a stationary end carried stationarily with the frame and a floating end; and mounting an engaging member to one of the piston shaft and the cylinder so that it is movable relative to the frame during relative movement of the piston shaft and cylinder;

moving the engaging member during the restoring movement until it contacts the floating end of the spring, wherein the force of the spring is sufficient to prevent the gas pressure from causing further restoring movement; wherein step (f) comprises:

pushing the floating end of the spring toward the stationary end of the spring with the engaging member; and wherein step (g) comprises:

moving the engaging member away from the floating end of the spring.

18. The method according to claim 16, wherein step (e) comprises:

mounting a spring to the exterior of the cylinder such that it has a stationary end carried stationarily with the frame and a floating end;

mounting a neutral stop to the frame in a position wherein the floating end will contact the neutral stop at a selected maximum expansion of the spring;

mounting an engaging member to one of the piston shaft and the cylinder so that it is movable relative to the frame during relative movement of the piston shaft and cylinder;

moving the engaging member during the restoring movement until it contacts the floating end of the spring while the floating end is in contact with the neutral stop, wherein the force of the spring is sufficient to prevent the gas pressure from causing further restoring movement; wherein step (f) comprises:

pushing the floating end of the spring out of contact with the neutral stop and toward the stationary end of the spring with the engaging member; and wherein step (g) comprises:

moving the engaging member away from the neutral stop and the floating end of the spring, with the floating end of the spring remaining in contact with the neutral stop.

* * * * *